US012742591B2

(12) United States Patent
Turney et al.

(10) Patent No.: US 12,742,591 B2
(45) Date of Patent: Sep. 22, 2026

(54) DUAL TEMPERATURE LIQUID OXYGEN SUBCOOLING IN AN AIR SEPARATION UNIT

(71) Applicant: L'Air Liquide, Societe Anonyme pour l'Etude et l'Exploitation des Procedes Georges Claude, Paris (FR)

(72) Inventors: Michael A. Turney, Houston, TX (US); Alain Guillard, Santa Ana, CA (US)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 137 days.

(21) Appl. No.: 18/635,494

(22) Filed: Apr. 15, 2024

(65) Prior Publication Data

US 2024/0353174 A1 Oct. 24, 2024

Related U.S. Application Data

(60) Provisional application No. 63/460,229, filed on Apr. 18, 2023.

(51) Int. Cl.
*F25J 3/04* (2006.01)

(52) U.S. Cl.
CPC ..... *F25J 3/04787* (2013.01); *F25J 3/04309* (2013.01); *F25J 3/04321* (2013.01); *F25J 3/04412* (2013.01); *F25J 2210/40* (2013.01); *F25J 2215/50* (2013.01); *F25J 2270/02* (2013.01); *F25J 2270/42* (2013.01); *F25J 2270/50* (2013.01); *F25J 2280/50* (2013.01)

(58) Field of Classification Search
CPC .... F25J 3/02; F25J 3/04; F25J 3/04006; F25J 3/04012; F25J 3/04018; F25J 3/04187; F25J 3/0423; F25J 3/04284; F25J 3/04309; F25J 3/04321; F25J 3/04406; F25J 3/04412; F25J 3/04472; F25J 3/04503; F25J 3/04509; F25J 5/002; F25J 2200/04; F25J 2200/06; F25J 2200/72; F25J 2200/74; F25J 2200/78; F25J 2210/40; F25J 2215/04; F25J 2215/50; F25J 2215/54; F25J 2245/02; F25J 2245/42; F25J 2245/50; F25J 2270/42; F25J 2270/50; F25J 2280/50; F25J 2290/12; F25J 2290/34; F25J 1/0264
USPC ..... 62/654, 657
See application file for complete search history.

(56) References Cited

U.S. PATENT DOCUMENTS 3,214,926 A 11/1965 Shaievitz et al.
4,152,130 A 5/1979 Theobald
(Continued)

FOREIGN PATENT DOCUMENTS

FR 3014181 A1 * 6/2015 ..... F25J 3/0409

OTHER PUBLICATIONS

FR-3014181-A1 English Translation (Year: 2015).*

*Primary Examiner* — Frantz F Jules
*Assistant Examiner* — Devon Moore
(74) *Attorney, Agent, or Firm* — Justin K. Murray

(57) ABSTRACT

A method for production of at least two liquid oxygen product streams from an air separation unit, wherein, the oxygen streams are cooled by heat exchange from at least one gaseous stream comprising predominantly nitrogen from the distillation column, and wherein the product liquid oxygen streams are at different temperatures.

20 Claims, 3 Drawing Sheets

(56) References Cited

U.S. PATENT DOCUMENTS

| | | | | |
|---|---|---|---|---|
| 9,733,014 | B2 * | 8/2017 | Schwenk | F25J 3/04448 |
| 2025/0271208 | A1 * | 8/2025 | Lochner | F25J 3/04496 |

* cited by examiner

DUAL TEMPERATURE LIQUID OXYGEN SUBCOOLING IN AN AIR SEPARATION UNIT

CROSS-REFERENCE TO RELATED APPLICATIONS

This application claims priority to U.S. Provisional Application Ser. No. 63/460,229 filed on Apr. 18, 2023, which is hereby incorporated by reference in its entirety.

TECHNICAL FIELD OF THE INVENTION

The present invention generally relates to a method and apparatus for efficiently operating an air separation plant that produces a liquid oxygen (LOX) stream. More specifically, the present invention relates to a method and apparatus for producing LOX at two different temperatures.

BACKGROUND OF THE INVENTION

Air separation plants separate atmospheric air into its primary constituents: nitrogen and oxygen, and occasionally argon, xenon and krypton. These gases are sometimes referred to as air gases.

A typical cryogenic air separation process can include the following steps: (1) filtering the air in order to remove large particulates that might damage the main air compressor; (2) compressing the pre-filtered air in the main air compressor and using interstage cooling to condense some of the water out of the compressed air; (3) passing the compressed air stream through a front-end-purification unit to remove residual water and carbon dioxide; (4) cooling the purified air in a heat exchanger by indirect heat exchange against process streams from the cryogenic distillation column; (5) expanding at least a portion of the cold air to provide refrigeration for the system; (6) introducing the cold air into the distillation column for rectification therein; (7) collecting nitrogen from the top of the column (typically as a gas) and collecting oxygen from the bottom of the column as a liquid.

During the process of liquid oxygen (LOX) production, the LOX is typically produced and stored at low pressure (1.03 to 1.4 bar (a)) and as a saturated liquid (i.e., bubble point), which is at a temperature of roughly −183° C. This is because cryogenic products (LOX, liquid nitrogen, liquid argon), cannot be stored in a subcooled state, since the system will naturally come to equilibrium conditions, thereby collapsing the pressure of the vapor space. See e.g., U.S. Pat. Nos. 3,214,926 and 4,152,130.

When customer demand requires a subcooled product (e.g., rapid LOX fueling to a rocket) then LOX is withdrawn from the saturated LOX storage (−183° C.) and subcooled to (approximately −190° C. to −206° C.) by heat transfer with an external saturated LIN stream(s).

It is desirable to have a process to reduce the external LIN refrigeration demand that is required for subcooling the LOX. Therefore, it would be advantageous to provide a method and apparatus that is operated in a more efficient manner.

SUMMARY OF THE INVENTION

The present invention is directed to a method and apparatus that satisfies at least one of these needs.

In addition to producing LOX at typical conditions at or near saturated (−183° C.), it is desirable for the ASU to also produce very subcooled LOX (e.g., less than −190° C.) product directly from the ASU.

In one embodiment, the first LOX stream (saturated, ~−183° C.) can be cooled in parallel to a stream that is lean in nitrogen (for temperature match). At least one second LOX stream (subcooled to <−185° C.) can be cooled in parallel to a stream that is rich in nitrogen (for cold temperature match).

In certain embodiments, the method for production of at least two liquid oxygen product streams from an air separation unit is provided. The method may include the steps of:

- providing the air separation unit comprised of a main heat exchange zone, a lower-pressure column, a higher-pressure column, an auxiliary heat exchange zone, and a second auxiliary heat exchange zone;
- cooling a compressed air stream in the main heat exchange zone to form a cooled air stream;
- introducing said cooled air stream into the higher-pressure column for rectification therein;
- withdrawing an oxygen-rich liquid from a bottom section of the higher-pressure column, expanding the oxygen-rich liquid, and then introducing said oxygen-rich liquid into an intermediate section of the lower-pressure column for rectification therein;
- withdrawing a nitrogen-rich liquid from an upper section of the higher-pressure column, expanding the nitrogen-rich liquid, and then introducing said nitrogen-rich liquid into an upper section of the lower-pressure column for rectification therein;
- withdrawing a gaseous nitrogen stream from the upper section of the lower-pressure column and warming, sequentially, said gaseous nitrogen stream in the second auxiliary heat exchange zone and then the auxiliary heat exchange zone to form a first warmed nitrogen stream;
- warming the first warmed nitrogen stream in the main heat exchange zone;
- withdrawing a liquid oxygen stream from a bottom section of the lower-pressure column and cooling the liquid oxygen stream in the auxiliary heat exchange zone to form a cooled liquid oxygen stream;
- splitting the cooled liquid oxygen stream into a first oxygen product stream and a second oxygen product stream, wherein the second oxygen product stream is subcooled in the second auxiliary heat exchange zone; and
- collecting the first oxygen product stream and the second oxygen product stream, wherein the second oxygen product stream is at a lower temperature as compared to the first oxygen product stream.

In optional embodiments of the method:

- the first oxygen product stream is at a first subcooled temperature in the range of −179° C. to −185° C., and wherein the second oxygen product stream is at a second subcooled temperature in the range of −183° C. to −193° C.;
- the first oxygen product stream is cooled in parallel to at least one first auxiliary liquid stream and the second oxygen product stream is cooled in parallel to at least one second auxiliary liquid stream;
- the first auxiliary liquid steam comprises <90% nitrogen;
- the first auxiliary liquid stream comprises the oxygen-rich liquid from the bottom section of the higher-pressure column;
- the second auxiliary liquid stream comprises >90% nitrogen;

the second auxiliary liquid stream comprises the nitrogen-rich liquid from the upper section of the higher-pressure column;

the auxiliary heat exchange zone and the second auxiliary heat exchange zone are combined in a common heat exchanger;

the auxiliary heat exchange zone and the second auxiliary heat exchange zone are in separate heat exchangers;

the method can also include the step of controlling the first subcooled temperature using a control system comprised of a controller that is configured to adjust the first subcooled temperature by varying a flow rate of a first fluid through a first bypass line, wherein the controller is further configured to adjust the second subcooled temperature by varying a flow rate of a second fluid through a second bypass line; and/or the first fluid and the second fluid are identical in composition to the liquid oxygen stream withdrawn from the bottom section of the lower-pressure column.

In another embodiment, an apparatus for production of at least two liquid oxygen product streams embodiment is provided. The apparatus may include:

a main air compressor;

a main heat exchange zone;

a higher-pressure column and a lower-pressure column, wherein the higher-pressure column and the lower-pressure column are thermally linked via a common condenser/reboiler that is disposed in a lower section of the lower-pressure column;

a first auxiliary heat exchange zone;

a second auxiliary heat exchange zone;

a liquid oxygen conduit in fluid communication with the lower section of the lower-pressure column and the first auxiliary heat exchange zone, wherein the first auxiliary heat exchange zone is configured to cool a liquid oxygen stream within the liquid oxygen conduit to a first subcooled temperature, thereby forming a cooled liquid oxygen stream, means for splitting the cooled liquid oxygen stream into a first oxygen product stream and a second oxygen product stream;

a first oxygen product conduit in fluid communication with the means for splitting the cooled liquid oxygen stream; and a second oxygen product conduit in fluid communication with the means for splitting the cooled liquid oxygen stream and the second auxiliary heat exchange zone, wherein the second auxiliary heat exchange zone is configured to cool the second oxygen product stream within the second oxygen product conduit to a second subcooled temperature, wherein the second subcooled temperature is lower than the first subcooled temperature In optional embodiments of the apparatus:

the first subcooled temperature is in the range of −179° C. to −185° C., and wherein the second subcooled temperature is in the range of −183° C. to −193° C.;

the first oxygen product stream is cooled in parallel to at least one first auxiliary liquid stream and the second oxygen product stream is cooled in parallel to at least one second auxiliary liquid stream;

the first auxiliary liquid stream comprises an oxygen-rich liquid from a bottom section of the higher-pressure column;

the second auxiliary liquid stream comprises a nitrogen-rich liquid from an upper section of the higher-pressure column;

the auxiliary heat exchange zone and the second auxiliary heat exchange zone are combined in a common heat exchanger;

the auxiliary heat exchange zone and the second auxiliary heat exchange zone are in separate heat exchangers;

the apparatus may also include a control system configured to control the first subcooled temperature, wherein the control system comprises a controller that is configured to adjust the first subcooled temperature by varying a flow rate of a first fluid through a first bypass line, wherein the controller is further configured to adjust the second subcooled temperature by varying a flow rate of a second fluid through a second bypass line, wherein the first bypass line is in fluid communication with the first oxygen product conduit, wherein the second bypass line is in fluid communication with the second oxygen product conduit; and/or the controller comprises a processor and memory coupled to the processor, wherein the memory stores instructions that, when executed by the processor, cause the processor to perform operations comprising: detecting the first subcooled temperature, detecting the second subcooled temperature, detecting a first flow rate within the first oxygen product conduit, detecting a second flow rate within the second oxygen product conduit, detecting a temperature within the liquid oxygen conduit, and adjusting the flow rates of the first and second fluids in the first and second bypass lines.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

The terms "nitrogen-rich" and "oxygen-rich" will be understood by those skilled in the art to be in reference to the composition of air. As such, nitrogen-rich encompasses a fluid having a nitrogen content greater than that of air. Similarly, oxygen-rich encompasses a fluid having an oxygen content greater than that of air.

Figure 1:
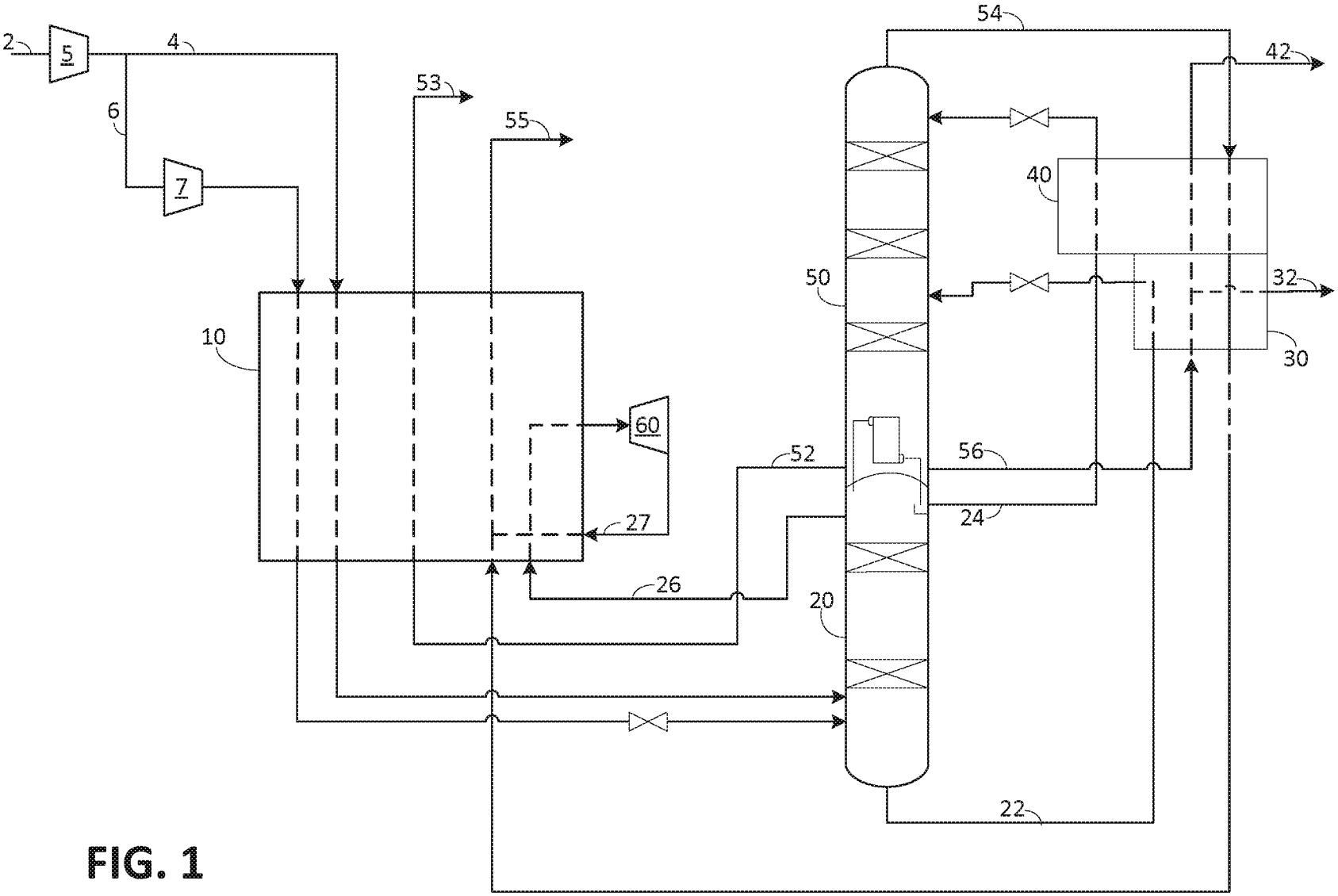
FIG. 1 provides an embodiment of the present invention.

Now turning to FIG. 1, air stream 2 is compressed in main air compressor 5, wherein it can be split into two streams. First stream 4 can be sent to main heat exchange zone 10, wherein it is fully cooled before being introduced into higher-pressure column 20. Second stream 6, can be further compressed in booster compressor 7, before it is sent to main heat exchange zone 10, wherein it is fully cooled. Upon leaving the cold end of main heat exchange zone 10, boosted second stream is expanded in a JT valve before being introduced into higher-pressure column 20.

Higher-pressure column 20 is configured to separate air into oxygen-rich liquid 22 and nitrogen-rich gas 26. This oxygen-rich liquid 22 is withdrawn from a bottom section of higher-pressure column 20, subcooled in first auxiliary heat exchange zone 30, and then expanded across another JT valve, before being introduced into lower-pressure column 50 for further rectification therein.

Figure 2:
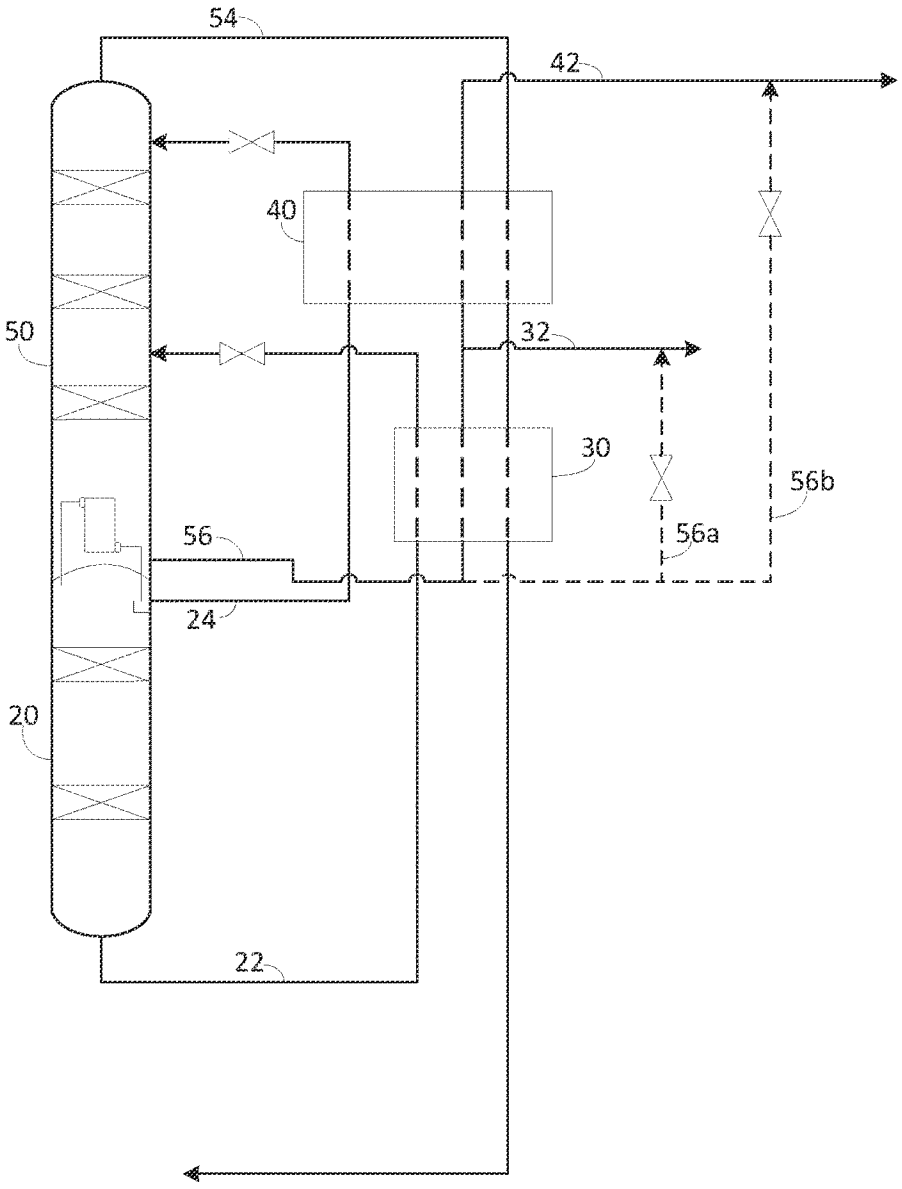
FIG. 2 provides a second embodiment of the present invention.
Figure 3:
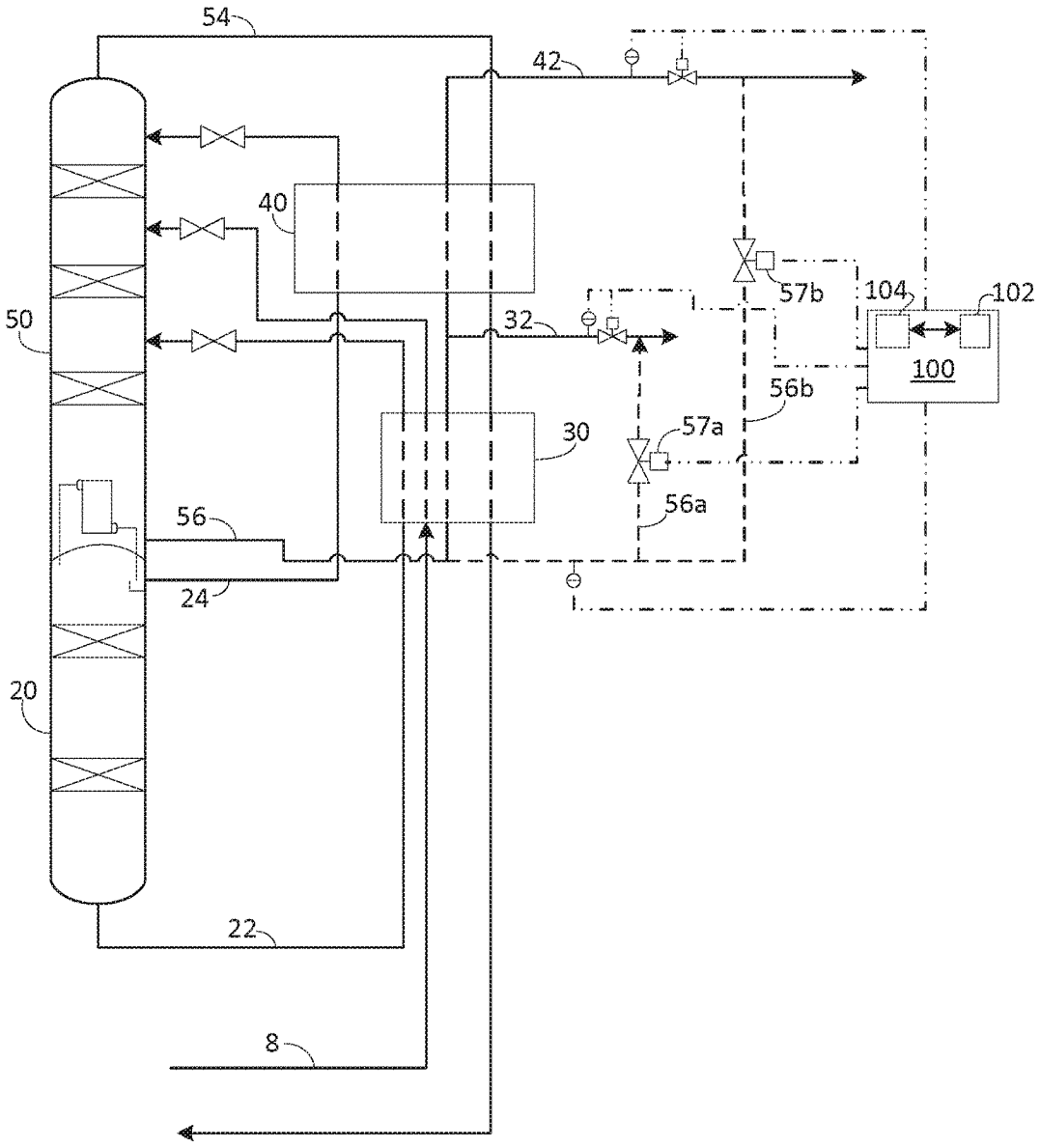
FIG. 3 provides another embodiment of the present invention.

A common condenser/vaporizer is disposed in a lower section of lower-pressure column 50, and it is configured to condense rising nitrogen-rich gas from the higher-pressure column 20 while vaporizing oxygen-rich liquid in the lower section of the lower-pressure column 50. The condensed nitrogen can be withdrawn as nitrogen-rich liquid 24 from an upper section of higher-pressure column 50, before being subcooled in second auxiliary heat exchange zone 40, and then expanded across another JT valve, before being introduced into lower-pressure column 50 for further rectification therein. In the embodiment shown in FIG. 1, both the first and second auxiliary heat exchangers are shown as forming a common heat exchanger. FIGS. 2 and 3 show embodiments in which the two heat exchangers are distinct separate units.

Lower-pressure column 50 is configured to further rectify the air gases, resulting in relatively pure liquid oxygen (LOX) settling in the lower section of lower-pressure column 50, while gaseous nitrogen collects at a top section of lower-pressure column 50. In the embodiment shown, lower-pressure gaseous nitrogen 54 can be withdrawn from the lower-pressure column 50, and then warmed sequentially in second auxiliary heat exchange zone, first auxiliary heat exchange zone, and main heat exchange zone.

A first LOX stream 52 can be withdrawn from lower-pressure column 50, and then vaporized in main heat exchange zone to form gaseous oxygen 53. In the embodiment shown, additional refrigeration for main heat exchange zone can be provided by withdrawing a higher-pressure gaseous nitrogen stream 26 from higher-pressure column 20, wherein it is partially warmed in main heat exchange zone 10, before being expanded in turbine 60, and then reintroduced into main heat exchange zone 10 for further warming, wherein it can be combined with lower-pressure gaseous nitrogen 54 to form warm gaseous nitrogen 55. While not shown, turbine 60 and booster air compressor 7 can share a common shaft, such that turbine 60 is configured to provide rotational power for booster air compressor 7.

A second LOX stream 56 can be withdrawn from lower-pressure column 50, wherein it is further cooled in first auxiliary heat exchange zone 30 to form a cooled LOX stream, preferably to a first subcooled temperature in the range of −179° C. to −185° C. This cooled LOX stream can then be split into a first oxygen product stream 32 and a second oxygen product stream 42, wherein the first oxygen product stream 32 is collected at the first subcooled temperature, while the second oxygen product stream 42 is further cooled in second auxiliary heat exchange zone to a second subcooled temperature in the range of 183° C. to −193° C. and collected at this second subcooled temperature. Consequently, embodiments of the present invention allow for collection of liquid oxygen at two different temperatures, all without the use of externally provided nitrogen.

FIGS. 2 and 3 are similar in nature to FIG. 1; however, in an effort to reduce clutter, they do not include items that are upstream of the higher-pressure column. In particular, FIG. 3 provides for an embodiment in which the temperatures of the first and second oxygen product streams 32, 42 can be fine-tuned. In the embodiment shown, bypass lines 56*a*, 56*b* can be provided that allow for warmer LOX to be mixed with either of the oxygen product streams 32, 42 in order provide additional control of final temperatures of first and second oxygen product streams.

FIG. 3 is similar to FIG. 2, except that it provides an embodiment in which liquid air 8, which is split off from either first or second streams 4, 6 prior to entering higher-pressure column 50, is cooled in first auxiliary heat exchange zone 30, prior to expansion in a JT valve, before being introduced into lower-pressure column 50 for rectification therein. In short, FIG. 2 provides for an embodiment in which all of the liquid air from the main heat exchange zone is sent to higher-pressure column 20, while FIG. 3 provides for an embodiment in which some of the liquid air from the main heat exchange zone is also sent to the lower-pressure column 20. Those of ordinary skill in the art will recognize that the embodiment chosen will likely depend on liquid/vapor ratios desired in each distillation section of the lower and higher-pressure columns.

In an optional embodiment shown in FIG. 3, although equally applicable to both FIG. 1 and FIG. 2, the apparatus may also include a control system for controlling the temperature of first and second oxygen product streams 32, 42. In certain embodiments, the control system may include a controller 100 that is configured to adjust the temperature of the two streams by varying the flow rates of fluid through lines 56*a* and/or 56*b* by adjusting control valves 57*a*, 57*b*. In certain embodiments, the controller may comprise a processor 102 and memory 104 coupled to the processor 102, wherein the memory 104 stores instructions that, when executed by the processor 102, cause the processor 102 to perform operations comprising: detecting the first subcooled temperature, detecting the second subcooled temperature, detecting a first flow rate of the first oxygen product stream 32, detecting a second flow rate of the second oxygen product stream 42, detecting a temperature of the second LOX stream 56, and adjusting a flow rate of liquid oxygen through bypass lines 56*a*, 56*b* to achieve a predetermined temperature for each of the first and second oxygen product stream 32, 42. In a preferred embodiment, the flow rates are adjusted by using control valves 57*a*, 57*b* on bypass lines 56*a*, 56*b*.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

We claim:

1. A method for production of at least two liquid oxygen product streams from an air separation unit, the method comprising the steps of:

providing the air separation unit comprised of a main heat exchange zone, a lower-pressure column, a higher-pressure column, an auxiliary heat exchange zone, and a second auxiliary heat exchange zone;

cooling a compressed air stream in the main heat exchange zone to form a cooled air stream;

introducing said cooled air stream into the higher-pressure column for rectification in the higher-pressure column;

withdrawing an oxygen-rich liquid from a bottom section of the higher-pressure column, expanding the oxygen-rich liquid, and then introducing said oxygen-rich liquid into an intermediate section of the lower-pressure column for rectification in the lower-pressure column;

withdrawing a nitrogen-rich liquid from an upper section of the higher-pressure column, expanding the nitrogen-rich liquid, and then introducing said nitrogen-rich liquid into an upper section of the lower-pressure column for rectification in the lower-pressure column;

withdrawing a gaseous nitrogen stream from the upper section of the lower-pressure column and warming, sequentially, said gaseous nitrogen stream in the second auxiliary heat exchange zone and then the auxiliary heat exchange zone to form a first warmed nitrogen stream;

warming the first warmed nitrogen stream in the main heat exchange zone;

withdrawing a liquid oxygen stream from a bottom section of the lower-pressure column and cooling the liquid oxygen stream in the auxiliary heat exchange zone to form a cooled liquid oxygen stream;

splitting the cooled liquid oxygen stream into a first oxygen product stream and a second oxygen product stream, wherein the second oxygen product stream is subcooled in the second auxiliary heat exchange zone; and collecting the first oxygen product stream and the second oxygen product stream, wherein the second oxygen product stream is at a lower temperature as compared to the first oxygen product stream.

2. The method as claimed in claim 1, wherein the first oxygen product stream is at a first subcooled temperature in the range of −179° C. to −185° C., and wherein the second oxygen product stream is at a second subcooled temperature in the range of −183° C. to −193° C.

3. The method as claimed in claim 1, wherein the auxiliary heat exchange zone and the second auxiliary heat exchange zone are combined in a common heat exchanger.

4. The method as claimed in claim 1, wherein the auxiliary heat exchange zone and the second auxiliary heat exchange zone are in separate heat exchangers.

5. The method as claimed in claim 2, wherein the first oxygen product stream is cooled in parallel to at least one first auxiliary liquid stream and the second oxygen product stream is cooled in parallel to at least one second auxiliary liquid stream.

6. The method as claimed in claim 2, further comprising controlling the first subcooled temperature using a control system comprised of a controller that is configured to adjust the first subcooled temperature by varying a flow rate of a first fluid through a first bypass line, wherein the controller is further configured to adjust the second subcooled temperature by varying a flow rate of a second fluid through a second bypass line.

7. The method as claimed in claim 5, wherein the first auxiliary liquid steam comprises <90% nitrogen.

8. The method as claimed in claim 5, wherein the first auxiliary liquid stream comprises the oxygen-rich liquid from the bottom section of the higher-pressure column.

9. The method as claimed in claim 5, wherein the second auxiliary liquid stream comprises >90% nitrogen.

10. The method as claimed in claim 5, wherein the second auxiliary liquid stream comprises the nitrogen-rich liquid from the upper section of the higher-pressure column.

11. The method as claimed in claim 6, wherein the first fluid and the second fluid are identical in composition to the liquid oxygen stream withdrawn from the bottom section of the lower-pressure column.

12. An apparatus for production of at least two liquid oxygen product streams, the apparatus comprising:

a main air compressor;

a main heat exchange zone;

a higher-pressure column and a lower-pressure column, wherein the higher-pressure column and the lower-pressure column are thermally linked via a common condenser/reboiler that is disposed in a lower section of the lower-pressure column;

a first auxiliary heat exchange zone;

a second auxiliary heat exchange zone;

a liquid oxygen conduit in fluid communication with the lower section of the lower-pressure column and the first auxiliary heat exchange zone, wherein the first auxiliary heat exchange zone is configured to cool a liquid oxygen stream within the liquid oxygen conduit to a first subcooled temperature, thereby forming a cooled liquid oxygen stream, a first oxygen product conduit in fluid communication with the liquid oxygen conduit thereby forming a first oxygen product stream; and a second oxygen product conduit in fluid communication with the liquid oxygen conduit and the second auxiliary heat exchange zone, thereby forming a second oxygen product stream wherein the second auxiliary heat exchange zone is configured to cool the second oxygen product stream within the second oxygen product conduit to a second subcooled temperature, wherein the second subcooled temperature is lower than the first subcooled temperature.

13. The apparatus as claimed in claim 12, wherein the first subcooled temperature is in the range of −179° C. to −185° C., and wherein the second subcooled temperature is in the range of −183° C. to −193° C.

14. The apparatus as claimed in claim 12, wherein the auxiliary heat exchange zone and the second auxiliary heat exchange zone are combined in a common heat exchanger.

15. The apparatus as claimed in claim 12, wherein the auxiliary heat exchange zone and the second auxiliary heat exchange zone are in separate heat exchangers.

16. The apparatus as claimed in claim 13, wherein the first oxygen product stream is cooled in parallel to at least one first auxiliary liquid stream and the second oxygen product stream is cooled in parallel to at least one second auxiliary liquid stream.

17. The apparatus as claimed in claim 13, further comprising a control system configured to control the first subcooled temperature, wherein the control system comprises a controller that is configured to adjust the first subcooled temperature by varying a flow rate of a first fluid through a first bypass line, wherein the controller is further configured to adjust the second subcooled temperature by varying a flow rate of a second fluid through a second bypass line, wherein the first bypass line is in fluid communication with the first oxygen product conduit, wherein the second bypass line is in fluid communication with the second oxygen product conduit.

18. The apparatus as claimed in claim 16, wherein the first auxiliary liquid stream comprises an oxygen-rich liquid from a bottom section of the higher-pressure column.

19. The apparatus as claimed in claim 16, wherein the second auxiliary liquid stream comprises a nitrogen-rich liquid from an upper section of the higher-pressure column.

20. The apparatus as claimed in claim 17, wherein the controller comprises a processor and memory coupled to the processor, wherein the memory stores instructions that, when executed by the processor, cause the processor to perform operations comprising: detecting the first subcooled temperature, detecting the second subcooled temperature, detecting a first flow rate within the first oxygen product conduit, detecting a second flow rate within the second oxygen product conduit, detecting a temperature within the liquid oxygen conduit, and adjusting the flow rates of the first fluid and the second fluids in the first bypass line and the second bypass lines.

* * * * *